US011091887B1

(12) United States Patent
Hogan

(10) Patent No.: US 11,091,887 B1
(45) Date of Patent: Aug. 17, 2021

(54) MACHINE FOR MILLING PAVEMENT AND METHOD OF OPERATION

(71) Applicant: Caterpillar Paving Products Inc., Brooklyn Park, MN (US)

(72) Inventor: Lee M. Hogan, Champlin, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 0 days.

(21) Appl. No.: 16/781,578

(22) Filed: Feb. 4, 2020

(51) Int. Cl.
*E01C 23/088* (2006.01)
*E01C 23/12* (2006.01)

(52) U.S. Cl.
CPC ..... *E01C 23/088* (2013.01); *E01C 23/127* (2013.01)

(58) Field of Classification Search
CPC ..... E01C 23/088; E01C 23/127
See application file for complete search history.

(56) References Cited

U.S. PATENT DOCUMENTS 4,646,620 A * 3/1987 Buchl ..... F15B 15/24 172/4
4,775,940 A * 10/1988 Nishida ..... A01B 63/1112 172/4.5
6,253,160 B1 6/2001 Hanseder
6,371,566 B1 4/2002 Haehn
7,984,953 B2 * 7/2011 Gaertner ..... E01C 23/127 299/1.5
8,690,474 B2 4/2014 Jurasz et al.
8,977,442 B2 3/2015 Menzenbach et al.
9,039,320 B2 * 5/2015 Snoeck ..... E01C 23/085 404/84.05
10,266,996 B2 4/2019 Hogan et al.
2005/0207841 A1 * 9/2005 Holl ..... B28D 7/00 404/94
2008/0153402 A1 * 6/2008 Arcona ..... B24B 7/188 451/352
2017/0138004 A1 * 5/2017 Berning ..... E01C 23/127
2019/0210525 A1 7/2019 Laclef et al.

* cited by examiner

*Primary Examiner* — Janine M Kreck
(74) *Attorney, Agent, or Firm* — Leydig, Volt & Mayer, Ltd.; Jeff A. Greene

(57) ABSTRACT

A machine for milling pavement such as a road planer or a rotary mixer includes a cutting rotor for penetrating and fracturing a work surface. To adjust the vertical elevation of the cutting rotor, the machine includes a rotor elevation mechanism. The machine may also include a rotor elevation control system that is programmed to lower the cutting rotor to initially contact the work surface. When the cutting rotor initially contacts the work surface, the touch point may be used as a reference to calibrate the rotor elevation mechanism prior to further lowering the cutting rotor into the work surface.

20 Claims, 5 Drawing Sheets

MACHINE FOR MILLING PAVEMENT AND METHOD OF OPERATION

TECHNICAL FIELD

This patent disclosure relates generally to a machine for milling a work surface such as a road planer or rotary mixer and, more particularly, to a rotor elevation control system and method for adjusting the vertical position of a cutting rotor mounted on the machine with respect to the work surface.

BACKGROUND

There exist various machines for removing or milling matter such as pavement, asphalt, or concrete from a work surface such as a roadway or similar surfaces. For example, road planers, also known as pavement profilers, road milling machines or cold planers, typically have a plurality of tracks or, in some cases, wheels that support and horizontally transport the machine along the surface of the road to be milled, and have a rotatable cutter that is vertically adjustable with respect to the road surface. As the road planer travels over the roadway and the rotatable cutter is brought into contact with the work surface, picks or teeth-like cutting tools that are disposed about the cylindrical exterior of the rotatable cutter can impact, penetrate into, and fragment or break apart the top layer of the surface for removal allowing the surface to be repaved. A rotary mixer is another example of a machine having a rotatable cutter that can be used to fragment a portion of the work surface and can grind and remix the material as part of a reclamation process.

To adjust the depth of cut or to disengage the rotatable cutter with the work surface the rotatable cutter is often operably associated with an elevation mechanism to vertically raise or lower the elevation of the cutter with respect to the work surface. Because the operator is stationed on top of the machine, they must either dismount the machine to visually determine the vertical elevation of the rotatable cutter with respect to the surface or work in conjunction with another individual who is positioned to view the rotatable cutter.

Attempts to facilitate or automate the adjustment of the vertical elevation of the rotatable cutter with respect to the work surface have been made. For example, U.S. Pat. No. 9,039,320, titled Method of Milling Asphalt, describes a road planer with an electronic controller programmed with a depth control system to adjust the extension mechanism and change the vertical elevation of the rotatable cutter. The depth control system utilizes a plurality of floating plates hung from the side of the machine and the slide over the work surface as the machine travels to measure the location of the surface. The control system is further configured to adjust the elevation of the rotatable cutter in accordance with a predetermined design elevation. The present disclosure is directed to an improved system and method for vertically positioning a cutting rotor on a machine with respect to the work surface.

SUMMARY

The disclosure describes, in one aspect, a machine for milling a work surface such as a roadway covered in pavement or asphalt. The machine includes a frame on a plurality of traction devices and a rotating cutting rotor with a plurality of cutting tools supported on the frame. To vertically move the cutting rotor, a rotor elevation mechanism is also included. An electronic controller of the machine may be programmed with a rotor elevation control system to lower the cutting rotor from a disengaged position toward the work surface. The rotor elevation control system can also receive a scratch signal indicating that the cutting rotor has initially contacted the work surface and calibrate the rotor extension mechanism with a scratch position.

In another aspect, the disclosure describes a method for positioning a cutting rotor with respect to a work surface. A cutting rotor is lowered with respect to a frame of a machine from a disengaged position toward a work surface with a rotor elevation mechanism. When the cutting rotor initially contacts the work surface, a scratch signal is generated and communicated to an electronic controller that, in response, calibrates a rotor elevation control system stored therein In yet another aspect of the disclosure, there is described a control system for a machine having a cutting rotor. The control system includes a sensor for generating and communicating a scratch signal indicative that a cutting rotor has initially contacted a work surface to an electronic controller. The electronic controller can be programmed to receive the scratch signal and, in response, measure the elevational setting of a rotor elevation mechanism and calibrate the rotor elevation mechanism with a scratch point reference indicative of the uppermost surface of the work surface.

DETAILED DESCRIPTION

Figure 1:
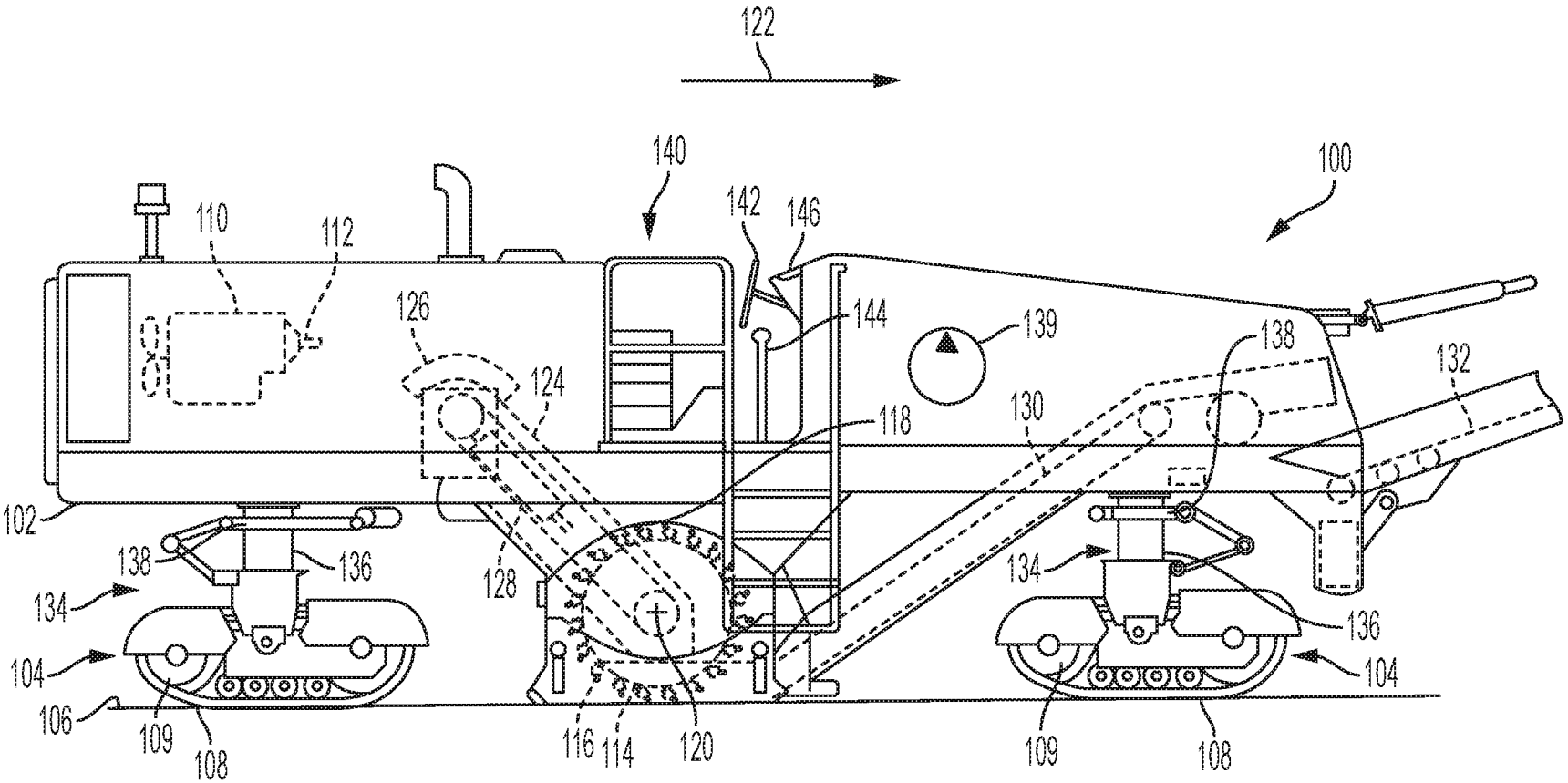
FIG. 1 is a side elevational view of a machine, in particular, a road planer having a cutting rotor and configured with a rotor elevation control system for adjusting the elevational position of the cutting rotor with respect to a work surface in accordance with the disclosure.

Now referring to the drawings, wherein whenever possible like reference numbers refer to like features, there is illustrated in FIG. 1 a machine in the particular embodiment of a road planer 100, which may also be referred to in the alternative as a cold planer, road miller, or the like. As will be familiar to those of ordinary skill in the art, road planers are utilized in road repair and repaving operations to remove pavement or other materials from the top surface of a road, highway or similar work surface. The road planer 100 can include a frame 102 that is generally supported on a plurality of ground-engaging traction devices 104 that are designed to contact and propel the road planer over the work surface 106. In the particular embodiment illustrated, the traction devices are track assemblies that include horizontally arranged continuous tracks 108 or a closed belt disposed about spaced-apart rollers 109 or sprockets. When the rollers 109 are rotated, they move the continuous track 108 about in a loop so that the frame 102 of the cold planer is carried over the work surface 106. In other embodiments, though, the traction devices can be wheels or other suitable ground propulsion devices known in the art.

To power the ground-engaging traction devices 104, the road planer 100 can include a power source 110 disposed on the frame 102. The power source 110 and other components that may ordinarily be hidden from view by panels or surfaces of the road planer 100 are indicated in dashed lines. In the illustrated embodiment, the power source 110 may be an internal combustion engine such as a diesel burning, compression ignition engine but in other embodiments other types of power sources can be utilized such as hybrid engines, gas burning engines, turbines, and the like. The power source 110 can generate rotary power harnessed and transmitted by a rotating drive shaft 112 extending from the power source. The rotating drive shaft 112 can be operatively associated with one or more of the ground-engaging traction devices 104 through a hydraulic system including hydraulic pumps, conduits, actuator, and the like that utilize pressurized hydraulic fluid to cause the ground-engaging traction devices to move with respect to the work surface. As will be explained in further detail herein, the power source 110 can also be used to generate and supply power for the other components and systems associated with the road planer 100.

To remove a layer of pavement, asphalt, or other material from a road or similar work surface 106, the road planer 100 can include a power driven, cutting rotor 114 rotatably supported with respect to the frame 102. The cutting rotor 114 can be a drum-shaped, cylindrical structure having a plurality of picks or teeth-like cutting tools 116 disposed about its cylindrical surface. The cutting rotor 114 can further be rotatably accommodated in a housing 118 that depends from the frame 102 toward the work surface 106 and can be arranged so that its cylindrical shape and its axis of rotation 120 are traverse or perpendicular to the forward direction of travel 122 (indicated by arrow) of the road planer 100. The housing 118 and the cutting rotor 114 therein may extend across a substantial degree of the lateral width of the road planer 100. The cutting tools 116 are adapted to penetrate into the work surface 106 and remove a portion of the material as the road planer 100 advances along the forward direction of travel 122 through a process sometimes referred to as milling or planning. In some embodiments, the cutting tools may be removable from the cutting rotor for replacement as they become worn or damaged. To rotate the cutting rotor 114 about its axis of rotation 120, the cutting rotor can be operatively coupled to the power source 110 through a mechanical arrangement including cooperating belts 124, pulleys 126 and a belt tensioner 128.

To remove material as the cutting rotor 114 chips and fragments it apart from the work surface 106 during milling operations, the road planer 100 can include a conveyor assembly including a pickup conveyor 130 and a discharge conveyor 132. One end of the pickup conveyor 130 can be disposed proximate to the interface between the work surface 106 and the cutting rotor 114 to receive the material and can extend forwardly through the road planer 100. The housing 118 accommodating the cutting rotor 114 can assist in guiding material to the pickup conveyor 130, which delivers it to the discharge conveyor 132 extending from the forward end of the road planer 100. The discharge conveyor 132 can thereby feed the material to a dump truck or the like traveling ahead of the road planer 100.

To bring the cutting rotor 114 into and out of contact with the work surface 106, the road planer 100 can include a rotor elevation mechanism 134 adapted to vertically raise and lower the frame 102, including the cutting rotor 114 rotatably supported thereon, with respect to the work surface. In particular, the traction devices 104 can be connected to the frame 102 by vertically oriented, adjustable legs 136. The adjustable legs 136 can be telescopic cylinders that have a plurality of nested tubes that can extend with respect to each other and retract into each other. The adjustable legs 136 can be actuated by hydraulically powered cylinders 138 or the like to extend and retract in a telescoping manner, thereby either bringing the frame 102 and the cutting rotor 114 closer toward or farther from the ground surface. The adjustable legs 136 can thereby control the depth-of-cut into the work surface. Moreover, the adjustable legs 136 can be fully extended to completely disengage the cutting rotor 114 from the work surface 106 when the road planer 100 is traveling without being engaged in a milling operation. One possible advantage of using adjustable legs 136 to raise and lower the frame 102 with respect to the traction devices 104 and thus function as the rotor elevation mechanism 136 is that the weight of the road planer 100 can bear on the cutting rotor 114 to assist in the milling operation. Moreover, the housing 118 rotatably supporting the cutting rotor 114 can be rigidly fixed to the frame 102 of the road planer 100 so that the cutting rotor is buttressed against the work surface 106. Because the vertical height of the cutting rotor 114 does not change with respect to the frame 102, the planning or milling operations can be more precisely controlled through using only the adjustable legs 136.

The hydraulic cylinders 138 can be operatively associated with a hydraulic system 139 disposed on the road planer 100. The hydraulic system 139 can include a fluid reservoir, hydraulic pumps, control valves, and hydraulic conduits like tubing and hoses to direct pressurized hydraulic fluid to and from the cylinders. To power the hydraulic system 139, it can be operatively associated with the power source 160 and utilize the mechanical power produced by it to operate the hydraulic pump and pressurize the hydraulic fluid.

In various embodiments, the adjustable legs 136 of the rotor elevation mechanism 134 can be configured to operate in conjunction with each other for precision control of the vertical distance between the frame 102 and each of the traction devices 104, and thus the work surface 106, or may work independently of each other. For example, by varying the extension and/or retraction of the adjustable legs 136 located along one side, i.e. left hand, with respect to the adjustable legs on the other side, i.e. right hand, based on sensor input, positioning measurements, and the like, the road planer can achieve grade control and cross-slope sensitivity. Differences in the vertical extension of the left and right side adjustable legs 136 tilt the horizontal orientation of the cutting rotor with respect to the work surface 106 and enable the road planer 100 to form graded surfaces. Additionally, differing the vertical extension of the adjustable legs 136 located at the front of the road planer with respect to the rear enable the forward traction devices to travel on an un-milled surface and the rearward traction devices to travel on the milled surface.

To accommodate an operator of the road planer 100 and to locate the various controls and instruments that enable an operator to drive and operate the road planer, an operator's station 140 can be disposed on the frame 102 in a location providing visibility for carrying out the milling operation. In particular, the operator's station 140 can include a steering wheel 142 for directing the road planer 100 laterally to one side or the other side and can include a forward-neutral-reverse lever 144 that directs travel in the corresponding directions or places the road planer in neutral. In addition, the operator's station 140 can include an operator interface having various controls and/or input/output devices that allow the operator to interact with the electronic control unit and the control system of the road planer 100. In an embodiment, the operator interface may be configured in part as a visual display device 146 such as a touch activated screen. Such visual display devices 146 are sometime referred to as human machine interfaces (HMI).

Figure 2:
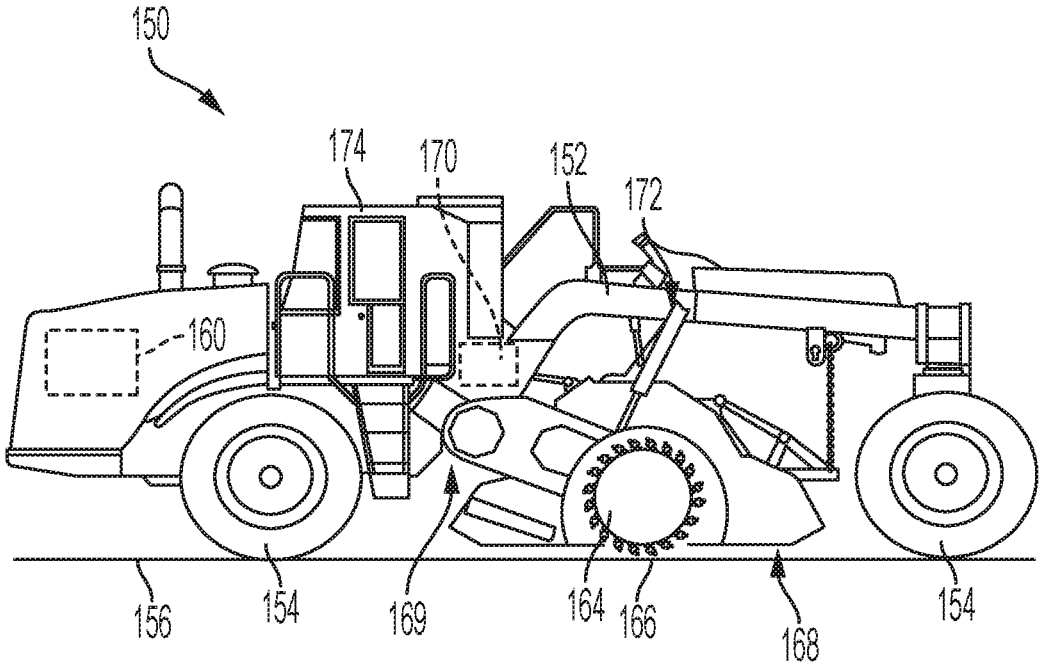
FIG. 2 is a side elevational view of another example of a machine, in particular, a rotary mixer having cutting rotor and configured with a rotor elevation control system for adjusting the elevational position of the cutting rotor with respect to a work surface in accordance with the disclosure.

Referring to FIG. 2, there is illustrated another embodiment of a machine having rotatable cutting rotor in the particular embodiment of a rotary mixer 150 for fragmenting and removing material from a roadway or similar work surface. The rotary mixer 150 can include a frame 152 mounted on a plurality of traction devices which, in the illustrated example, may be wheels 154 at the front and rear of the rotary mixer. One or more of the wheels 154 may be a drive wheel and others may be steer wheels to respectively propel and maneuver the rotary mixer over the work surface 156. To provide power for operation, the rotary mixer 150 can include a power source 160 that again may be an internal combustion engine that combusts a hydrocarbon-based fuel to convert the chemical energy stored therein to rotating mechanical motion. In other embodiments, the power source 160 may have a different configuration or operate based on different technologies.

To remove and reclaim or reuse a layer of pavement, asphalt, or other material from the work surface 156, the rotary mixer 150 can include a cutting rotor 164 rotatably mounted to the frame 152 and having plurality of cutting tools 166 attached thereto (shown in cutaway). As described with respect to the road planer in FIG. 2, the cutting rotor 164 can be a drum shaped, cylindrical structure and the cutting tools 166 such as picks can be removable for detachment and replacement. The cutting rotor 164 can be rotatably accommodated in a housing 168 that can function mixing enclosure. The housing 168 can generally extend across the width of the rotary mixer 150 and can be formed from side plates and other surfaces fastened or welded together. The housing 168 can be operatively associated with other systems to receive water or other material which can be mixed with the fragmented materials from the work surface 156. When the cutting rotor 164 rotates within the housing 168, the rotational motion mixes the materials together, which can be redeposited on the work surface 156 as an aggregate in a reclamation process.

To move the cutting rotor 164 into and out of engagement with the work surface 156, the housing 168 can be pivotally attached to the frame 152 at a pivot location 169, which may be included at each lateral side of the rotary mixer 150. More particular, the pivot location 169 may be located at the rear end of the housing 168 so that the housing can vertically articulate with respect to the frame 152. To move the housing 168 up and down about the pivot location 169, the rotary mixer 150 can be operatively associated with a rotor elevation mechanism that utilizes a hydraulic system 170 including one or more hydraulic actuators 172 such as hydraulic cylinders having a piston that is slidably extendable and retractable with respect to a cylinder body. The hydraulic actuators 172 can be connected at one end to the frame 152 and at the other end to a part of the housing 168. The hydraulic system 170 can include a fluid reservoir, hydraulic pumps, control valves, and hydraulic conduits like tubing and hoses and can be operatively associated with the power source 160. The hydraulic system 170 can utilize power from the power source 160 to pump and direct hydraulic fluid under pressure to the hydraulic actuators 172 thereby articulating the housing 168 and the cutting rotor 164 rotatably accommodated therein with respect to the work surface 156 and thus actuating the rotor elevation mechanism.

To accommodate the operator and various controls and instruments for operation of the rotary mixer 150, an operator station 174 can be disposed on the frame 152 in a location providing visibility over the worksite.

Figure 3:
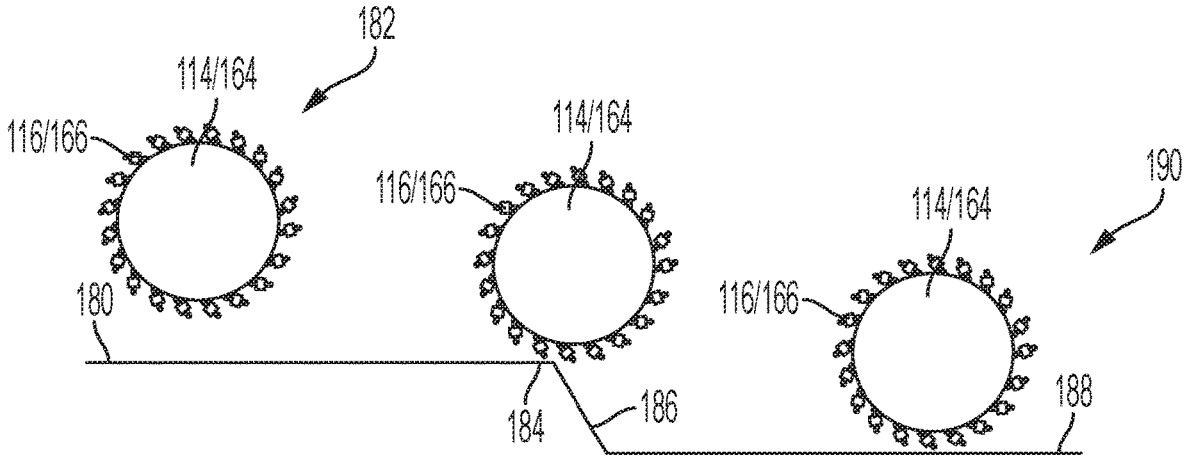
FIG. 3 is a schematic representation of the cutting rotor engaging the work surface by moving between a disengaged position and a cutting depth position.

Referring to FIG. 3, there is illustrated the position of the cutting rotor 114, 164 with respect to a work surface 106, 156 during different states of a milling operation. Initially, the cutting rotor 114, 164 may be raised or elevated in a disengaged position 182 with respect to an un-milled surface 180 by retracting the rotor elevation mechanism associated with the machine. At such a disengaged position 182, the cutting tools 116, 166 are not engaged with the work surface 106, 156 and the cutting rotor 114, 164 is vertically spaced above the un-milled surface 180. The machine accordingly can travel about the worksite without unintentionally damaging any surfaces.

To engage the work surface 106, 156, the rotor elevation control mechanism is actuated to lower the cutting rotor 114, 164 until it initially contacts the work surface. This may be referred to as the scratch point or touch point 184 and occurs at the moment of initial contact and prior to penetration of the cutting tools 116, 166 into the surface. Due to unevenness of the work surface 106, 156 or because grades are being applied to these surfaces, multiple scratch points or touch points 184 may occur as the lateral extension of the cutting rotor 114, 164 comes into contact with work surface at different points. As the cutting rotor 114, 164 is further vertically directed into or penetrates the work surface 106, 156, the cutting tools 116, 166 will form a cut in accordance with the cutting depth 186. The cutting rotor 114, 164 may be lowered into the work surface 106, 156 until a desired cutting depth 186 is achieved thereby forming a milled surface 188. The cutting depth 186 is therefore the vertical difference between the un-milled surface 180 and the milled surface 188. The cutting rotor 114, 164 can thereafter be maintained at this cutting depth position 190 to complete the milling operation and remove the material.

Figure 4:
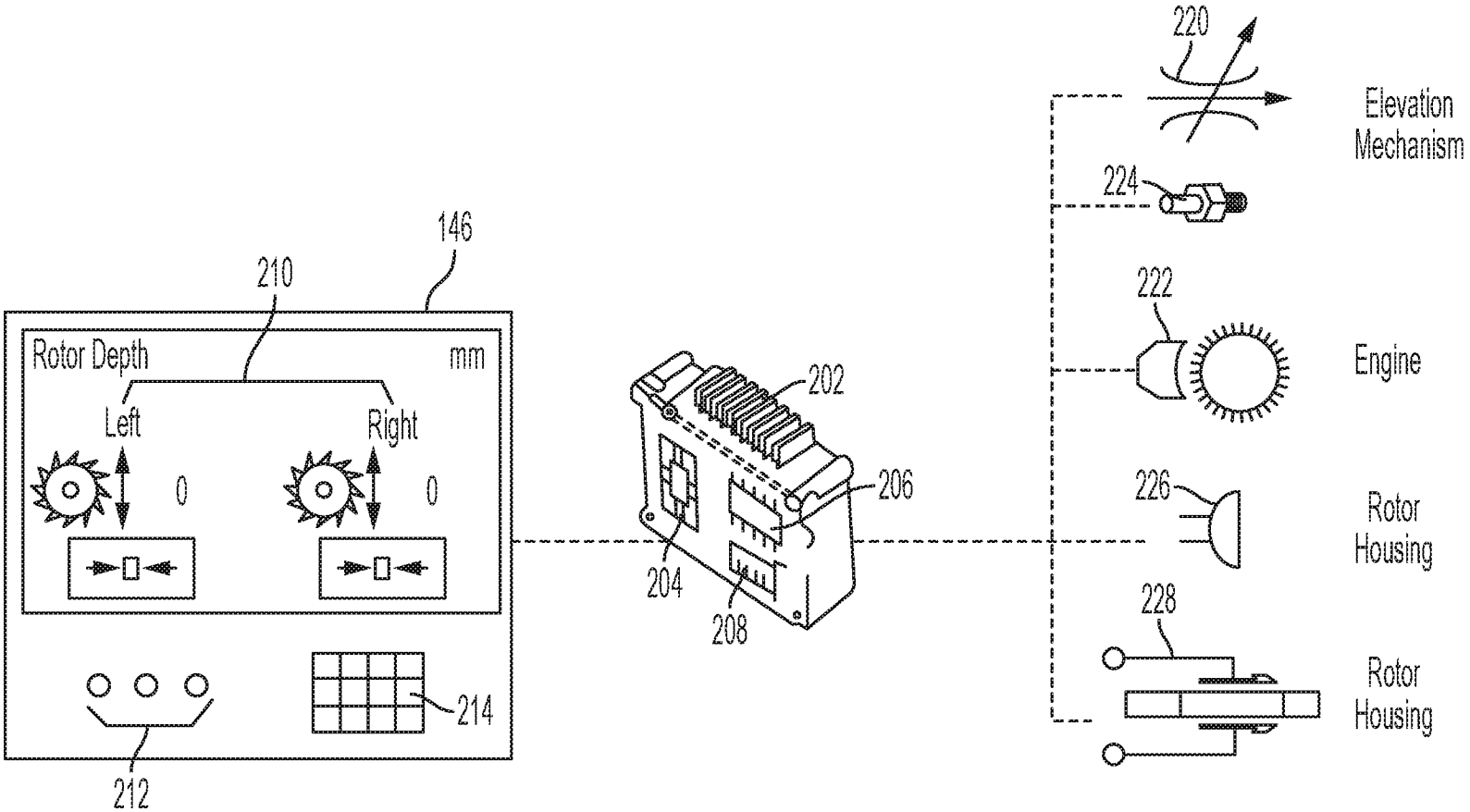
FIG. 4 is a schematic representation of an electronic controller configured with the rotor elevation control system and operatively associated with various sensors to receive a scratch signal.

Referring to FIG. 4, to determine the occurrence of a scratch point or touch point when the cutting rotor initially contacts the work surface prior to penetration and thereafter regulate the milling operation, the machine may be operatively associated with a rotor elevation control system 200. The rotor elevation control system 200 can be implemented in an electronic controller 202, sometimes referred to as an electronic control module, an electronic control unit, or sometimes just a controller. To perform the associated functions and operations of the rotor elevation control system 200, the electronic controller 202 can include one or more microprocessors 204 such as an application specific integrated circuit (ASIC), a field programmable gate array ("FPGA"), or other appropriate processing circuitry, and can include non-transient data and programmable memory 206, which may be in the form of random access memory and/or more permanent forms of data storage for storing software associated with the cutter elevation system. The microprocessor 204 may be capable of processing or performing any suitable computer-based functions, such as executing instructions, data processing, mathematical operations, and the like. The electronic controller 202 may also include input/output ports and circuitry 208 to communicate with other electronic devices. The electronic controller 202 may be associated with other software including any suitable instruction sets, programs, applications, routines, libraries, databases and the like, for carrying out its functions. Although in FIG. 4, the electronic controller 202 is illustrated as a single, discrete unit, in other embodiments, the electronic controller 202 and its functions may be distributed among a plurality of distinct and separate components.

In an embodiment, the electronic controller 202 may also be operatively associated with the visual display device 146 or HMI on the machine to interface with the operator, which may have touch screen functionalities and display information regarding the milling operation. For example, the visual display device 146 may display a visual indication 210 of the vertical elevation of the cutting rotor with respect to a reference. The visual indication 210 can be in any suitable units such as inches or millimeters. Because, as described above, the cutting depth is typically measured as the vertical distance between the un-milled surface and the milled surface, the reference may be the un-milled surface and the visual display 146 can represent the position of the cutting rotor from the un-milled surface. The operator may further be able to adjust the vertical elevation of the cutting rotor through the touch screen functionality of the visual display device 146 or through other dials 212, keypads 214 or inputs. In those embodiments in which the horizontal orientation of the cutting rotor, i.e., the angle of the rotor axis between the axial ends of the cylindrical drum, can be adjusted or slanted to form a graded surface, the visual display device 146 may display separate visual indications for the first and second, or left and right, axial ends of the cutting rotor.

In addition, the electronic controller 202 can send and receive information and data to and from various sensors and controls associated with the rotor elevation control system 200 through electronic communication via wires, cables, data buses or by wireless transmission technologies such as RFID. For example, to adjust the cutter elevation mechanism that determines the vertical elevation of the cutting rotor, the rotor elevation control system 200 can include one or more elevation controls 220. In the embodiments where the cutter elevation mechanism includes hydraulic actuators, the elevation controls can be flow control or flow direction valves to a selectively actuate the actuators. To determine or recognize the occurrence of a scratch point or touch point, the rotor elevation control system 200 can be associated with one or more subsystems that are configured to generate and communicate a scratch signal indicative that the cutting rotor has initially contacted the work surface. The scratch signal can be a form of electronic data transmitted in bits and bytes that the rotor elevation control system 200 can recognize as indicative of the occurrence of a scratch point or touch point.

To generate the scratch signal, in an embodiment, the rotor elevation control system 200 may include an engine monitoring subsystem including an engine speed sensor 222 operatively associated with the power source of the machine. When the cutting rotor initially contacts the work surface, the physical contact may initially reduce rotational speed of the cutting rotor impede travel of the machine causing the engine to slow down or lug. Accordingly, the rotational output of the engine is reduced which can be measured by the engine speed sensor 222. The engine speed sensor 222 may be a crankshaft position sensor which may be operatively associated with the crankshaft and measures engine speed drop in revolutions per minute. The engine speed sensor 222 can be a magnetic pickup device, a hall effect sensor, a toothed collar physically driving another component, an optical reflector, or have another suitable configuration.

In another embodiment, the scratch signal can be generated by monitoring the hydraulic system that may be associated with the rotor elevation mechanism used to vertically position the cutting rotor. In this embodiment, the rotor elevation control system 200 may include a hydraulic monitoring subsystem having one or more hydraulic sensors 224 that can be disposed at a suitable position or location with respect to the hydraulic system such as on the hydraulic actuators. When the cutting rotor initially contacts the work surface, further rotational or translational movement of the cutter rotor may be impeded, which may cause an increase in the fluid pressure of the hydraulic fluid. The hydraulic sensor 224 can be a fluid pressure sensor and may measure the pressure of the hydraulic fluid to sense such pressure spikes or increase and generate the scratch signal that is communicated to the electronic controller in response.

In another embodiment, the scratch signal can be generated in response to an audible sound or occurrence. For example, when the cutting rotor initially contacts the work surface, impact of the cutting tools into the surface will make an audible sound. The rotor elevation control system 200 may include one or more audio transducers 226 such as microphones that can receive the pressure variations associated with the audible sound of the cutting tools striking the work surface and convert them to an electrical signal representing the scratch signal. The audio transducer 226 may be of any suitable type and use any technology to generate the electrical signal including relative motions of a coil in a magnetic field, vibrating diaphragms coupled to an electric circuit, and piezoelectric materials. The audio transducers 226 may be disposed at different locations about the housing that accommodates the cutting rotor.

In another embodiment, the scratch signal can be generated in response to the vibrations or tactile response of the cutting tools initially contacting the work surface. It can be appreciated that when the cutting tools physically impact the surface, vibrations and oscillations may occur and be imparted or directed through the machine. The rotor elevation control system 200 can include one or more vibration sensors 228 disposed on the machine that converts the physical vibrations to an electrical signal that is the scratch signal. The vibration sensor 228 may operate on any technical principal and include strain gauges, accelerometers, piezoelectric elements, and the like and a plurality of vibration sensors can be disposed about the housing accommodating the cutting rotor or at other suitable locations on the machine.

In an embodiment, more than one sensor methodology can be used. In addition, because the cutting rotor is an elongated cylinder traverse to the direction of travel, the first axial end of the cutting cylinder may initially contact the work surface before the second axial end. In an embodiment, multiple sensors may be operatively associated with one axial end of the cutting rotor or the other axial end. For example, in a rotary mixer, hydraulic cylinders may be included on either side of the machine to adjust the elevation of the cutting rotor, and an increase in fluid pressure in a cylinder relative to the other cylinder may indicate which axial end of the cutting rotor initially contacted the work surface. Associating a hydraulic sensor 224 with each hydraulic cylinder enables the rotor elevation control system to isolate and determine which axial end of the cutting rotor initially contacted the work surface. In those embodiments using audio transducers 226 or vibration sensors 228, groups of sensors may be placed proximate the opposing axial ends of the cutting rotor, and the relative measurements compared to determine which axial end made the initial contact.

INDUSTRIAL APPLICABILITY

Figure 5:
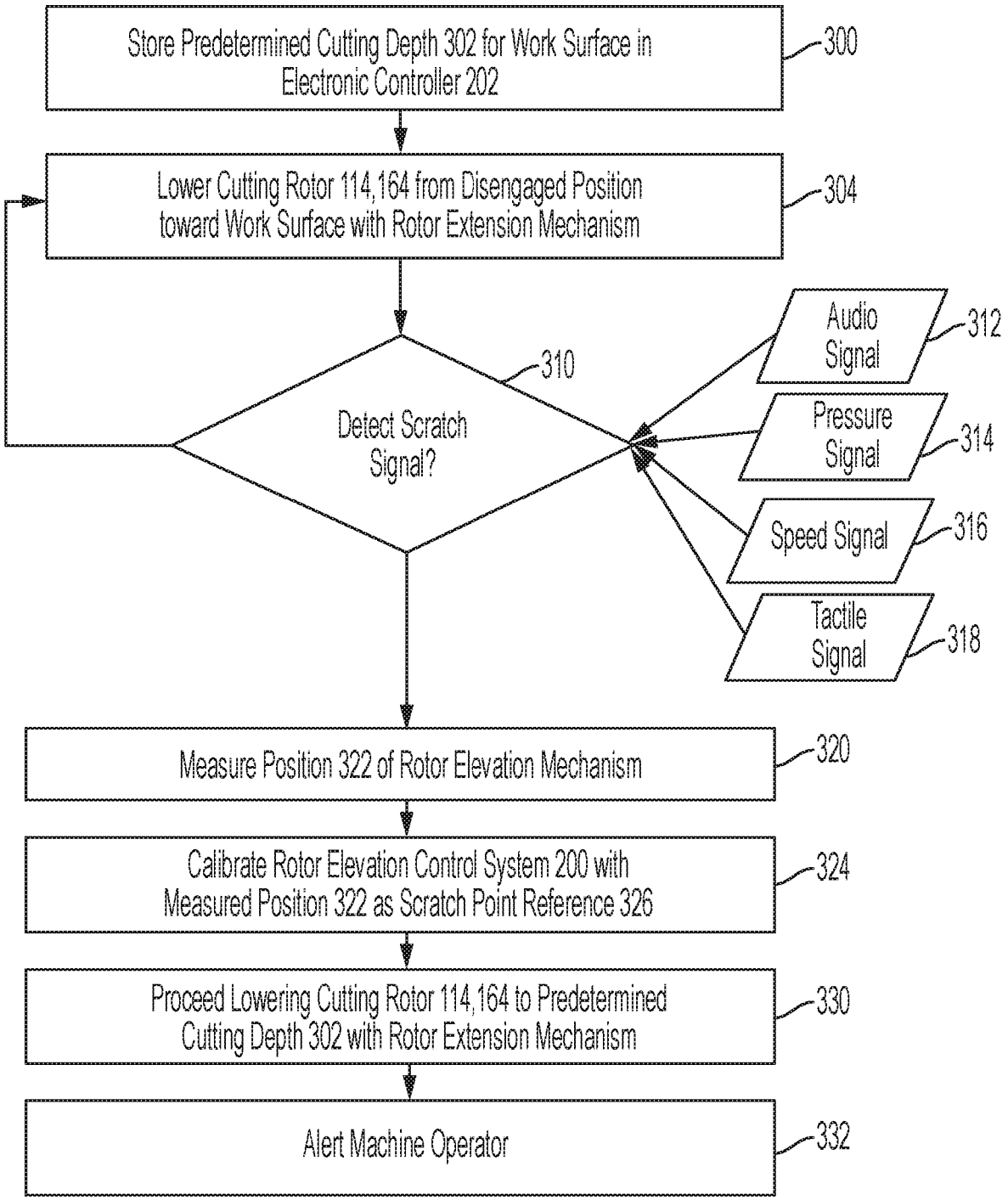
FIG. 5 is a flow diagram of a possible method for electronic implementation by the elevation control system to determine a scratch position of the cutting rotor.

The present disclosure is applicable to controlling the vertical elevation of a cutting rotor on a machine like a road planer or rotary mixer for milling a work surface covered with pavement or asphalt. Referring to FIG. 5 and in accordance with the prior figures, there is illustrated an exemplary process that may be performed by the rotor elevation control system 200. The process depicted in the flow diagram for accomplishing these tasks may include a series of steps or instructions implemented as non-transitory computer executable software code in the form of an application or program. In an initial data storage step 300, a predetermined cutting depth 302 can be stored in the electronic controller 202 associated with the rotor elevation control system 200 on a machine like a road planer 100 or rotary mixer 150. The predetermined cutting depth 302 can be the desired depth for the work surface after a pass of the machine and which may vary between passes and worksites. The predetermined cutting depth 302 can be a value stored in a digital form for processing by the electronic controller 202. As the machine begins a milling operation, the rotor elevation mechanism in an extension step 304 starts lowering the cutting rotor 114, 164 from a disengaged position where the cutting rotor is not in contact with and spaced above the work surface 106, 156 toward the surface. The time this takes will vary based on the initial disengaged position, rotor elevation mechanism speed, and possible other factors.

During this time, the rotor elevation control system 200 can be monitoring, in a monitoring and decision step 310, for a scratch signal indicative that the cutting rotor 114, 164 has made initial contact with the work surface 106, 156 and has not yet penetrated the work surface. This is the touch point or scratch point of the milling operation. The scratch signal can take any suitable form. The scratch signal can be an audio signal 312 made when the cutting tools 116, 166 on the cutting rotor 114, 164 initially impact on the work surface 106, 156. The scratch signal can also be a pressure signal 314 indicative of the fluid pressure of a hydraulic system associated with the rotor elevation mechanism, which may increase upon the initial contact of the cutting rotor 114, 164 with the work surface 106, 156. The scratch signal can be a speed signal 316 indicative of the engine speed, which may decrease at the initial contact of the cutting rotor 114, 164 with the work surface 106, 156. Further, the scratch signal can be a tactile signal 318 indicative of vibrations imparted to the machine by the initial contact. The scratch signal may also take other forms. These scratch signals are converted to an electrical output by an appropriate sensor type and communicated electronically to the electronic controller 202. To assess the scratch signal, it's output may be compared with other known signals outputs. However, until the rotor elevation control system 200 detects the scratch signal, the monitoring and decision step 310 will return to the extension step 304 to continue lowering the cutting rotor 114, 164 toward the work surface 106, 156.

When the rotor elevation control system 200 does detect or receive a scratch signal, in a measurement step 320, it measures the position 322 of the rotor elevation mechanism. The measurement may be calculated based on fluid pressure in the hydraulic cylinders, determined by proximity sensors, or accomplished by other methodologies. Through the measurement step 320 the rotor elevation control system 200 determines the precise settings of the rotor elevation mechanism at the point of initial contact with the work surface 106, 156 and uses that information as a reference. The electronic controller 202 can be responsible for the processing of measurement calculations. The rotor elevation control system 200 can, in a calibration step 324 thereafter, automatically calibrate itself using the measured position 322 of the rotor elevation mechanism as a scratch point reference 326 of the uppermost surface of the work surface 106, 156. By way of example, the scratch point reference 326 may be set to a zero value position of the cutting rotor 114, 164. Further extension of the rotor elevation mechanism at the scratch point reference 326 will penetrate the work surface 106, 156 and retraction will move the cutting rotor 114, 164 out of contact with the work surface. Further extension and retraction of the rotor elevation mechanism with respect to the point reference 326 can be assigned positive and negative values respectively.

In another extension step 330, the rotor elevation control system 200 can automatically continue lowering the cutting rotor 114, 164 with the rotor elevation mechanism to the predetermined cutting depth 302. If the predetermined cutting depth 302 is an absolute value, for example, 100 millimeters, the rotor elevation control system 200 can accurately achieve this dimension through use of the scratch point reference 326 as a calibration for further movement of the cutting rotor 114, 164, and thereby achieve more accurate cuts and milled surfaces. Moreover, as a possible advantage, the rotor elevation control system 200 avoids having operators need to visually confirm or check the vertical position of the cutting rotor 114, 164 during the milling operation.

In a possible further embodiment, the rotor elevation control strategy 200 can include an alarm step 332 to alert an operator of the machine that the cutting rotor 114, 164 and particularly the cutting tools 116, 166 have contacted the work surface. The alarm step 332 can be accomplished through an audible or visual alert to prompt the operator accordingly. For example, the operator may record or mark the present settings of the rotor elevation mechanism at which the cutting rotor 114, 164 contacts the work surface at a scratch or touch point which may be accomplished with assistance of the rotor elevation control system 200. The calibration process can be quickly and easily repeated each time a machine is about to make a new cut or pass to obtain a fresh reference point, It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

The use of the terms "a" and "an" and "the" and "at least one" and similar referents in the context of describing the invention (especially in the context of the following claims) are to be construed to cover both the singular and the plural, unless otherwise indicated herein or clearly contradicted by context. The use of the term "at least one" followed by a list of one or more items (for example, "at least one of A and B") is to be construed to mean one item selected from the listed items (A or B) or any combination of two or more of the listed items (A and B), unless otherwise indicated herein or clearly contradicted by context.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

I claim:

1. A machine for milling a work surface comprising:

a frame supported on a plurality of traction devices;

a cutting rotor rotatably supported on the frame, the cutting rotor including a plurality of cutting tools;

a rotor elevation mechanism configured to vertically move the cutting rotor with respect to the work surface;

a sensor configured to sense a scratch position and transmit a scratch signal; and an electronic controller programmed with a rotor elevation control system adapted to a) lower the cutting rotor from a disengaged position toward the work surface, b) receive the scratch signal from the sensor indicative that the cutting rotor has initially contacted the work surface, and c) calibrate the rotor elevation mechanism with scratch position.

2. The machine of claim 1, wherein the rotor elevation control system is adapted to further lower the cutting rotor to a predetermined cutting depth stored in the electronic controller.

3. The machine of claim 1, wherein the sensor includes an audio transducer in electrical communication with the electronic controller and the scratch signal is generated from an audible sound of the cutting rotor initially contacting the work surface.

4. The machine of claim 1, further comprising an internal combustion engine operatively associated with the cutting rotor for rotating the cutting rotor with respect to the work surface, the internal combustion engine wherein the sensor includes an engine speed senor in electrical communication with the electronic controller, wherein the scratch signal is generated from a speed signal from the engine speed sensor.

5. The machine of claim 1, further comprising a hydraulic system including at least one hydraulic actuator operatively associated with the rotor elevation mechanism, the hydraulic system wherein the sensor includes a pressure sensor in electrical communication with the electronic controller, wherein the scratch signal is generated from the pressure sensor.

6. The machine of claim 1, wherein the sensor includes a vibration sensor and the scratch signal is generated from vibrations caused by the cutting rotor initially contacting the work surface.

7. The machine of claim 1, wherein the cutting rotor is a cylindrical drum traverse to the frame and the scratch signal is associated with a first axial end or a second axial end of the cutting rotor.

8. The machine of claim 7, where in the sensor is a first sensor, and further comprising a second sensor for generating a second scratch signal, the second sensor associated with one of the first axial end and second axial end of the cutting rotor.

9. The machine of claim 1, wherein the rotor elevation mechanism includes a plurality of adjustable legs operatively associated with the plurality of traction devices and operably configured to raise and lower the frame and the cutting rotor rotatably supported thereon with respect to the work surface.

10. The machine of claim 1, wherein the cutting rotor is accommodated in a housing pivotally connected to the frame, and the rotor elevation mechanism includes a hydraulic cylinder operably configured to pivot the housing and cutting rotor therein with respect to the work surface.

11. The machine of claim 1, wherein the electronic controller is in communication with a visual display device enabled to display detection of the scratch signal.

12. A method of positioning a cutting rotor with respect to a work surface comprising:

lowering a cutting rotor with respect to a frame of a machine from a disengaged position toward a work surface with a rotor elevation mechanism;

detecting a scratch signal indicative that the cutting rotor has initially contacted the work surface at a scratch position; and calibrating a rotor elevation control system stored in an electronic controller on the machine with the scratch position in response to receiving the scratch signal from a scratch sensor.

13. The method of claim 12, wherein the scratch signal is detected by the scratch sensor that includes one or more of an audio transducer and a vibration sensor.

14. The method of claim 12, wherein the scratch signal is detected by the scratch sensor that includes an engine speed sensor.

15. The method of claim 12, wherein the scratch signal is a pressure signal detected by the scratch sensor that includes a pressure sensor measuring fluid pressure in a hydraulic system operatively associated with the rotor elevation mechanism.

16. The method of claim 12, further comprising lower the cutting rotor to a predetermined cutting depth with respect to the work surface.

17. The method of claim 12, wherein the scratch signal is indicative of a first axial end of the cutting rotor initially contacting the work surface; and further comprising detecting a second scratch signal indicative of a second axial end of the cutting rotor initially contacting the work surface.

18. A control system for a machine having a cutting rotor comprising:

a sensor for generating and communicating a scratch signal indicative that a cutting rotor operatively associated with rotor elevation system had initially contacted a work surface; and an electronic controller programed with a rotor elevation control system adapted to receive the scratch signal, measure an elevational setting of the rotor elevation mechanism, and calibrate the rotor elevation mechanism with the scratch signal to utilize a scratch point reference indicative of an uppermost surface of the work surface.

19. The control system of claim 18, wherein the sensor is selected from the group comprising an audio transducer, an engine speed sensor, a fluid pressure sensor, and a vibration sensor.

20. The control system of claim 19, wherein the sensor is a first sensor, and further comprising a second sensor with the first sensor associated with a first axial end of the cutting rotor and the second sensor associated with the second axial end of the cutting rotor.

* * * * *